US005919097A

United States Patent [19]

Cole

[11] Patent Number: 5,919,097

[45] Date of Patent: Jul. 6, 1999

[54] GOLF SWING INDICATOR

[76] Inventor: Richard Ancel Cole, 504 Hanover, Waxahachie, Tex. 75165

[21] Appl. No.: 09/002,403

[22] Filed: Jan. 2, 1998

[51] Int. Cl.[6] ..... A63B 69/36

[52] U.S. Cl. ..... 473/212; 434/252

[58] Field of Search ..... 434/252; 473/207, 473/208, 212, 210

[56] References Cited

U.S. PATENT DOCUMENTS 4,239,228 12/1980 Norman et al. ..... 473/212

4,691,924 9/1987 Strong ..... 473/212

4,896,887 1/1990 Cable ..... 473/212

*Primary Examiner*—Kien T. Nguyen

*Attorney, Agent, or Firm*—Morgan L. Crow, P.E.

[57] ABSTRACT

A golf swing indicator having a base to be attached to the upper arm of a golfer and having a flexible pointer extending outwardly from the base and detachably secured to the base. A strap is provided to attach the indicator to the user's arm. The indicator may be used on the user's forward or rearward arm and will indicate proper and improper swings.

14 Claims, 1 Drawing Sheet

GOLF SWING INDICATOR

BACKGROUND OF THE INVENTION

1. The Field of the Invention

This invention relates to golf training devices, which gives the golfer an indication of certain body movements which are used to teach a golfer to swing a golf club in a desired manner.

2. The Related Prior Art

In U.S. Pat. 55,443,266 issued to Hugh A. Bursi in 1995, there is disclosed a golf swing training aid with sound producing tabs attached to a body strap and an arm band to produce an audible sound when tabs strike together during a proper down swing.

In U.S. Pat. 4,257,607, issued to Zygmund Nedwick in 1981, there is disclosed an flat arrowhead shaped golf swing guide with side spurs of unequal length to be detachably attached to a golfer's glove or mid-riff site to determine a correct swing.

In U.S. Pat. 5,152,532, issued to Christopher,D. Rouse, there is disclosed a golf stroke training attachment for the backside of a golfer's glove to indicate proper alignment during a golf stroke. In U.S. Pat. 5,529,306, issued to Theodore J. Staats, et. al., there is disclosed a golf training device comprising a stick, with elastic bands for connection to maintain a constant distance between the left pectoral muscle and the right forearm for a right handed golfer.

SUMMARY OF THE INVENTION

DESCRIPTION OF THE PREFERRED EMBODIMENT

Figure 1:
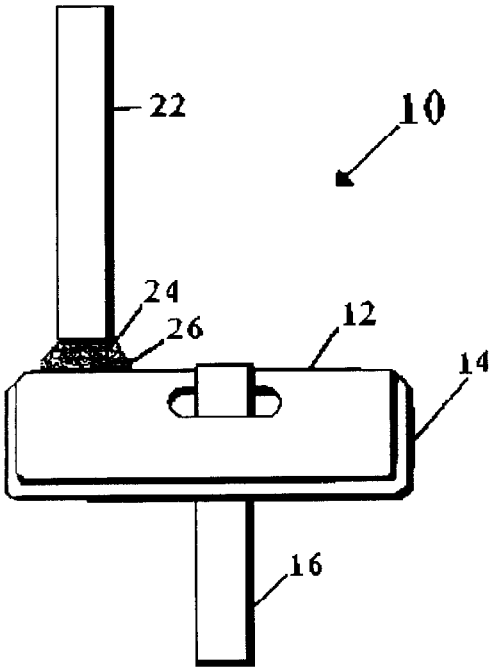
FIG. 1 is a side elevation view of the invention.
Figure 2:
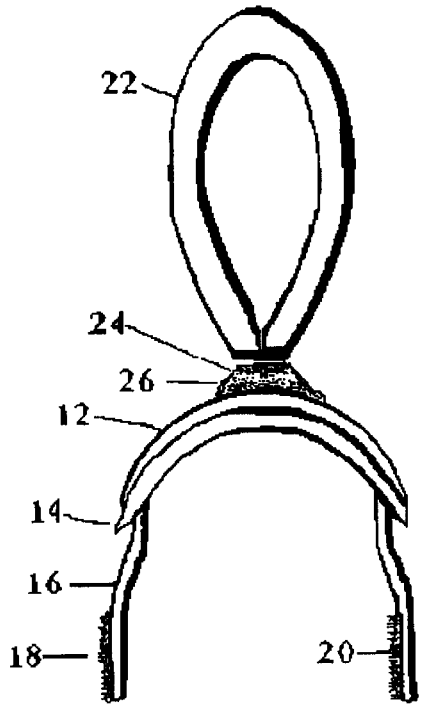
FIG. 2 is an end elevation view of the invention.

Referring to FIGS. 1 and 2, there is a golf swing indicator shown generally at 10. There is a body 12 formed of a plastic sheet of approximately ⅛" thickness and formed generally as a portion of a cylinder. Padding 14 cushions the golfer's arm from the body 10. Strap 16 is used to attach the indicator 10 to the golfer's arm. A hook and pile fastener such as Velcro® is used to fasten the ends of the strap together with the hook portion of the fastener at 18 and the pile portion at 20. The loop indicator 22 is attached to the body 12 with a set of hook and pile fasteners such as Velcro®, with the hook portion of the fastener at 24 and the pile portion at 26.

Figure 3:
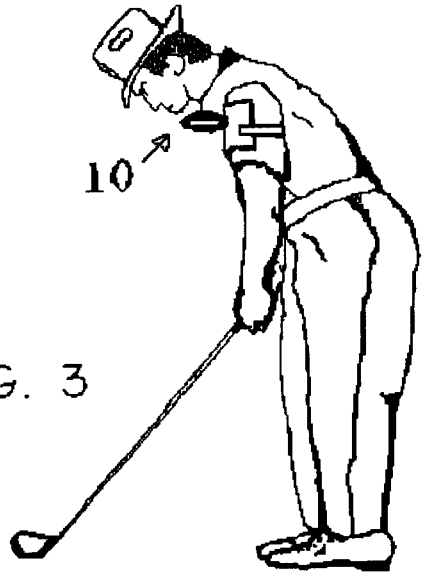
FIG. 3 is a side elevation view of a golfer with the invention in place on his left arm.

Referring to FIG. 3, there is shown a right handed golfer with the invention worn on his arm. The invention should be worn so that the indicator loop projects generally in a direction perpendicular to a line across the golfer's toes when he stands ready to take his swing to strike the ball. Use of the hook and pile method attachment of the indicator makes this indicator useful during a game of golf, permitting a golfer attach the indicator 22 to the body 12 to take some practice swings. The loop and pile fastener may be separated, removing the indicator 22 from the body 12 for storage in the golfer's pocket or golf bag until another practice session may be desired. The body 12 may be left in place on the golfers arm without interfering with the golf game or other activities.

This invention may be used at times on the forward and rearward arms of the golfer to achieve a proper swing. Use of the invention on the forward arm will aid the golfer to achieve a proper backswing. Use of the invention on the rearward arm will aid the golfer in achieving a proper follow through to the golf swing This invention, when used on the forward arm, as described in this paragraph, will give the golfer a clear indication of his or her relationship between the user's body and ball location, during the backswing. For example, if user takes an address position which is farther away from the ball which is satisfactory for an effective golf swing, and such rearward swing is made, this invention's loop indicator will be thrust upward toward user's facial area instead of the correct, behind the head and out of vision manner which is desired for a correct golf swing. This invention also when used on the forward arm of golfer gives such user a correct indication of rear or trailing arm position, if rear or training arm does not fold and move in a downward position, during the back swing, but instead takes a move up and away from user's body position, then this invention's loop indicator will thrust towards user's face instead of the more desired position which is behind user's head and more obscured from his vision. This invention also when used on the forward arm of the user gives him or her a clear indication of such path the club might take. In the backswing:

- in a correct back swing of a golf club, the club takes a path in a plane containing the address position of the club. The loop indicator will move past the user's face behind the user's head and somewhat out of vision.
- If the back swing is below the desired plane, this invention's loop indicator will be thrust to a relatively lower position below the user's face.
- If the back swing is above the desired plane, this invention's loop indicator will be thrust in a upward position towards user's face.

This invention also when used on the forward arm of the user gives the same effect if the opposite path of the club takes the opposite path or direction and such swinging implement goes out away from the user's body once again this invention's loop indicator will be thrust upward toward users face instead of the more desired position which is behind users head and out of vision. This invention also when used on the forward arm of such user gives the user a clear indication of the proper weight transfer which in a correct rearward portion of a golf swing, the users weight shifts rearward on the backswing and forward on the downswing motion, if the golfer fails to achieve this transfer of weight properly, this invention's loop indicator will automatically be thrust upward into the user's face. This invention also when used on the forward arm and repositioned more towards and covering the forward arm and more specifically the elbow portion, user now must adhere to a more one piece motion because said invention will not allow user's forward arm to bend excessively which in a good one piece swing motion user's forward arm should stay reasonably straight giving the user correct muscle memory. This invention, also when used on the forward arm gives the user an indication of excessive body swaying motion. In the proper rearward portion of the golf swing, the users body shifts, but does not sway or lean rearwardly. If such an incorrect move is made, this invention's loop indicator will not be behind users head, but more in the facial area of the user.

This invention when used on the forward arm gives such user a proper posture position. If a proper posture position is not implemented then once again this invention's loop indicator on the rearward portion of the swing will be thrust upward toward user's face, instead of the more desired behind the user's head position. This invention when used on the rearward arm, as described in this paragraph, gives the user indications:

In the proper follow through position, upon a correct termination of forward swinging motion this invention's loop indicator will indicate to golfer if the correct motion and path were made. If loop indicator is in a vertical position directly in front and even with user's head, then a correct swing motion was made.

A severe outside to inside path or forward thrust of upper body motion would lead indicator to a lower and more nearly horizontal position.

This invention, when used on the rearward arm, as described in this paragraph, will give the golfer a clear indication of his or her relationship between the user's body and ball location, at the end of the swing. This invention also when used on the forward arm of the user gives him or her a clear indication of such path the club might take. At the end of the swing:

in a correct forward swing of a golf club, the club takes a path in a plane containing the address position of the club, but in a plane below the plane of the backswing. The loop indicator will move past the user's face past the user's head and somewhat out of the field of vision.

If the forward swing is below the desired plane, this invention's loop indicator will be thrust to a relatively lower position below the user's face and relatively lower in the user's field of vision.

If the forward swing is above the desired plane, this invention's loop indicator will be thrust in a upward position towards user's face and more into the user's field of vision.

The indicator 22 may be a length of flexible material formed into a loop and having both ends attached to the body 12. In an alternate embodiment, the indicator could be a length of flexible material stiff enough to extend from the body 12, having one end attached to body 12 and the other end positioned at the farthermost position away from body 12. The cross section of the preferred embodiment could be square, round, rectangular or other shape.

The indicator 22 extends 4 inches from the body 12 in the preferred embodiment. In use, the length could be as little as 2 inches or a much as 8 inches. A smaller range of length could be as little as 3 inches or as much as 5 inches. The indicator of the present invention could be attached to a golfer's leg to indicate proper positioning of the leg before, during and at the end of a golf swing. This invention is useful on any limb of a golfer, arm or leg.

I have disclosed a golf club swing indicator to be worn an upper rearward arm of a golfer, in the course of swinging a golf club for indicating a proper or improper arm orientation position at the and of the golf swing which comprises a body, having an arcuate shape suitable for embracing a golfer's arm, including an inner surface and an outer surface, means for mounting said body to an arm of a golfer and an indicator attached to and extending a predetermined distance away from said outer surface, and comprising a length of flexible material having a pair of opposite ends, at least one of said ends attached to the outer surface of said body and positioned within the golfer's field of vision at the end of said swing, whereby the orientation of said indicator affords a reference indication of the correctness of the completed swing, and further has a pair of opposite ends each attached to the outer body surface, and wherein the means for holding the inner surface of the body to an arm of a person comprise at least one strap having two ends and operably engaging the body, and fasteners on the strap which include hook and pile fasteners. I have disclosed a golf swing indicator for attachment to an upper arm of a golfer, for indicating a proper or improper arm position with respect to the body during a swing comprising a body contoured with an outer side, and an inner side to fit on an upper arm of a person, an indicator of flexible material detachably secured to the outer side, and a strap operably engaging the body, whereby the strap can be used to attach the inner side to an arm of a person have disclosed a golf swing indicator for attachment to an upper arm of a golfer, for indicating a proper or improper arm position with respect to the golfer's body during a swing comprising means for securing a body of the indicator to a limb of a user, means for visual indication of a proper or improper swing in the field of vision of the golfer secured to the body means.

Although elements of the invention have been illustrated in the accompanying drawings and described in the foregoing Description it will be understood that the invention is not limited to the embodiments disclosed, but is capable of rearrangements, modifications, substitutions and reversals of parts and elements without departing from the spirit of the invention.

I claim:

1. A golf club swing indicator to be worn an upper rearward arm of a golfer, in the course of swinging a golf club for indicating a proper or improper arm orientation position at the end of the golf swing comprising:

a body, having an arcuate shape suitable for embracing a golfer's arm, including an inner surface and an outer surface, means for mounting said body to an arm of a golfer and an indicator attached to and extending a predetermined distance away from said outer surface, and comprising a length of flexible material having a pair of opposite ends, at least one of said ends attached to the outer surface of said body and positioned within the golfer's field of vision at the end of said swing, whereby the orientation of said indicator affords a reference indication of the correctness of the completed swing.

2. A golf swing indicator according to claim 1 further comprising:

said indicator having said pair of opposite ends each attached to said outer body surface.

3. A golf swing indicator according to claim 1 wherein said means for holding said inner surface of said body to an arm of a person comprise at least one strap having two ends and operably engaging said body, and fasteners on said strap which include hook and pile fasteners.

4. The golf swing indicator of claim 1 wherein said indicator extends between 2 and 8 inches from said body.

5. The golf swing indicator of claim 1 wherein said indicator extends between 3 and 5 inches from said body.

6. The golf swing indicator of claim 1 wherein said indicator extends substantially 4 inches from said body.

7. A gulf swing indicator for attachment to an upper arm of a golfer, for indicating a proper or improper arm position with respect to the body during a swing comprising:

a body contoured with an outer side, and an inner side to fit on an upper arm of a person, a visual indicator of flexible material detachably secured to said outer side, and a strap operably engaging said body, whereby said strap can be used to attach said inner side to an arm of a person.

8. The golf swing indicator of claim 7 wherein said indicator extends between 2 and 8 inches from said body.

9. The golf swing indicator of claim 7 wherein said indicator extends between 3 and 5 inches from said body.

10. The golf swing indicator of claim 7 wherein said indicator extends substantially 4 inches from said body.

11. A golf swing indicator for attachment to a limb of a golfer, for indicating a proper or improper position with respect to the body during a swing comprising:

means for securing a body of said indicator to the upper arm of a user, means for visual indication of a proper or improper swing in the field of vision of the golfer secured to said body means.

12. A golf club swing indicator to be worn an upper forward arm of a golfer, in the course of swinging a golf club for indicating a proper or improper arm orientation position in the back swing comprising:

a body, having an arcuate shape suitable for embracing a golfer's arm, including an inner surface and an outer surface, means for mounting said body to an arm of a golfer and an indicator attached to and extending a predetermined distance away from said outer surface, and comprising a length of flexible material having a pair of opposite ends, at least one of said ends attached to the outer surface of said body and positioned within the golfer's field of vision at the and of a back swing, whereby the orientation of said indicator affords a reference indication of the correctness of the back swing.

13. A golf swing indicator according to claim 12 further comprising:

said indicator having said pair of opposite ends each attached to said outer body surface.

14. A golf swing indicator according to claim 12 wherein said means for mounting said body to an arm of a golfer comprise at least one strap having two ends and operably engaging said body, and fasteners on said strap which include hook and pile fasteners.

* * * * *